US009205484B2

(12) United States Patent
Zhao et al.

(10) Patent No.: US 9,205,484 B2
(45) Date of Patent: Dec. 8, 2015

(54) HIGH THERMAL CONDUCTIVITY SHELL MOLDS

(71) Applicant: General Electric Company, Schenectady, NY (US)

(72) Inventors: Qi Zhao, Niskayuna, NY (US); Stephen Francis Rutkowski, Duanesburg, NY (US); Francis Johnson, Clifton Park, NY (US); Wanming Zhang, Clifton Park, NY (US); Min Zou, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 190 days.

(21) Appl. No.: 14/091,386

(22) Filed: Nov. 27, 2013

(65) Prior Publication Data

US 2015/0144287 A1 May 28, 2015

(51) Int. Cl.

| | |
|---|---|
| ***B22C 1/02*** | (2006.01) |
| ***B22C 3/00*** | (2006.01) |
| ***B22C 9/02*** | (2006.01) |

(52) U.S. Cl.
CPC ... *B22C 1/02* (2013.01); *B22C 3/00* (2013.01); *B22C 9/02* (2013.01)

(58) Field of Classification Search
CPC ..... B22C 1/02; B22C 9/02
USPC ..... 164/23, 24, 361, 516–520, 529; 106/38.2, 38.22, 38.27, 38.28, 38.3
See application file for complete search history.

(56) References Cited

U.S. PATENT DOCUMENTS

| | | | | |
|---|---|---|---|---|
| 3,266,106 | A * | 8/1966 | Lirones | 164/517 |
| 4,655,276 | A * | 4/1987 | Bird et al. | 164/519 |
| 5,335,717 | A * | 8/1994 | Chin et al. | 164/519 |
| 5,391,606 | A | 2/1995 | Doles | |
| 5,937,932 | A * | 8/1999 | Cornie | 164/526 |
| 6,024,163 | A * | 2/2000 | Springgate et al. | 164/519 |
| 6,352,101 | B1 | 3/2002 | Ghosh et al. | |
| 6,431,255 | B1 | 8/2002 | Ghosh et al. | |
| 6,467,534 | B1 | 10/2002 | Klug et al. | |
| 8,033,320 | B2 | 10/2011 | Gigliotti et al. | |
| 8,283,047 | B2 | 10/2012 | Vogt et al. | |
| 8,372,327 | B2 | 2/2013 | Matsen et al. | |
| 2009/0126894 | A1 | 5/2009 | Elliott et al. | |
| 2010/0018666 | A1 | 1/2010 | Gigliotti et al. | |
| 2011/0315338 | A1 | 12/2011 | Gigliotti et al. | |
| 2012/0119407 | A1 | 5/2012 | Nichol et al. | |
| 2013/0160967 | A1 | 6/2013 | Suzuki et al. | |

OTHER PUBLICATIONS

Rajan et al., "Solidification and Casting/Mould Interfacial Heat Transfer Characteristics of Aluminum Matrix Composites", Regional Research Laboratory (Csir), Thiruvanathapuram 695 019, India, Issue Date: Jan. 2007, vol. 67, Issue 1, pp. 70-78.

* cited by examiner

*Primary Examiner* — Kevin E Yoon
(74) *Attorney, Agent, or Firm* — Paul J. DiConza

(57) ABSTRACT

A shell mold is described. The shell mold includes a facecoat, a sealcoat, and a support disposed in between the facecoat and the sealcoat. The support includes a stucco in a concentration greater than about 40 volume percent of the support. The stucco includes a material that has a thermal conductivity greater than about 285 W/m-K.

15 Claims, 4 Drawing Sheets

HIGH THERMAL CONDUCTIVITY SHELL MOLDS

BACKGROUND

The present disclosure generally relates to shell molds for directional casting, and more particularly, to high thermal conductivity shell mold compositions that provide a high heat extraction rate.

In the manufacture of components, such as nickel based superalloy turbine blades and vanes for turbine engines, directional solidification (DS) investment casting techniques have been employed to produce columnar grain and single crystal casting microstructures having improved mechanical properties at the high temperatures encountered in the turbine section of the engine.

For directional solidification of superalloys, the solid-liquid interface applies a high thermal gradient to yield good cast microstructure. In order to provide a high thermal gradient, heat needs to be removed quickly from the solid casting.

Conventional investment shell molds for directional solidification of super alloys and other transition metal-based alloys are made of alumina or zircon particulates. Typical thermal conductivities of the conventional shell molds are about 1.42 W/m-K for alumina shells and 1.62 W/m-K for zircon shells. The typical shell thickness ranges between 8 to 12 millimeters depending on casting size and geometry. Heat extraction from solidifying casting in Liquid Metal Cooling (LMC) directional solidification is limited by shell heat conduction when the conventional shell molds are applied. Accordingly, there remains a need for molds with improved heat extraction through thermal conductivity increase or shell thickness reduction, or both.

BRIEF DESCRIPTION

Disclosed herein are high thermal conductivity shell molds and processes for forming the high thermal conductivity mold shells. In one embodiment, a shell mold is described. The shell mold includes a facecoat, a sealcoat, and a support disposed in between the facecoat and the sealcoat. The support includes a stucco in a concentration greater than about 40 volume percent of the support. The stucco includes a material that has a thermal conductivity greater than about 285 W/m-K.

Another aspect of the invention relates to a shell mold. The shell mold includes a facecoat, a sealcoat, and a support disposed in between the facecoat and the sealcoat. The facecoat includes alumina, and is disposed on an inner surface of the shell mold. The sealcoat is disposed on an outer surface of the shell mold and includes a high emissivity material. The support includes greater than about 50 volume percent of silicon carbide stucco in an alumina, zircon, or mullite fine particle dispersion. The median size of silicon carbide stucco is greater than about 100 microns, and a thickness of the shell mold is less than about 7 mm.

BRIEF DESCRIPTION OF THE DRAWINGS

The disclosure may be understood more readily by reference to the following detailed description of the various features of the disclosure and the examples included therein.

DETAILED DESCRIPTION

Figure 1:
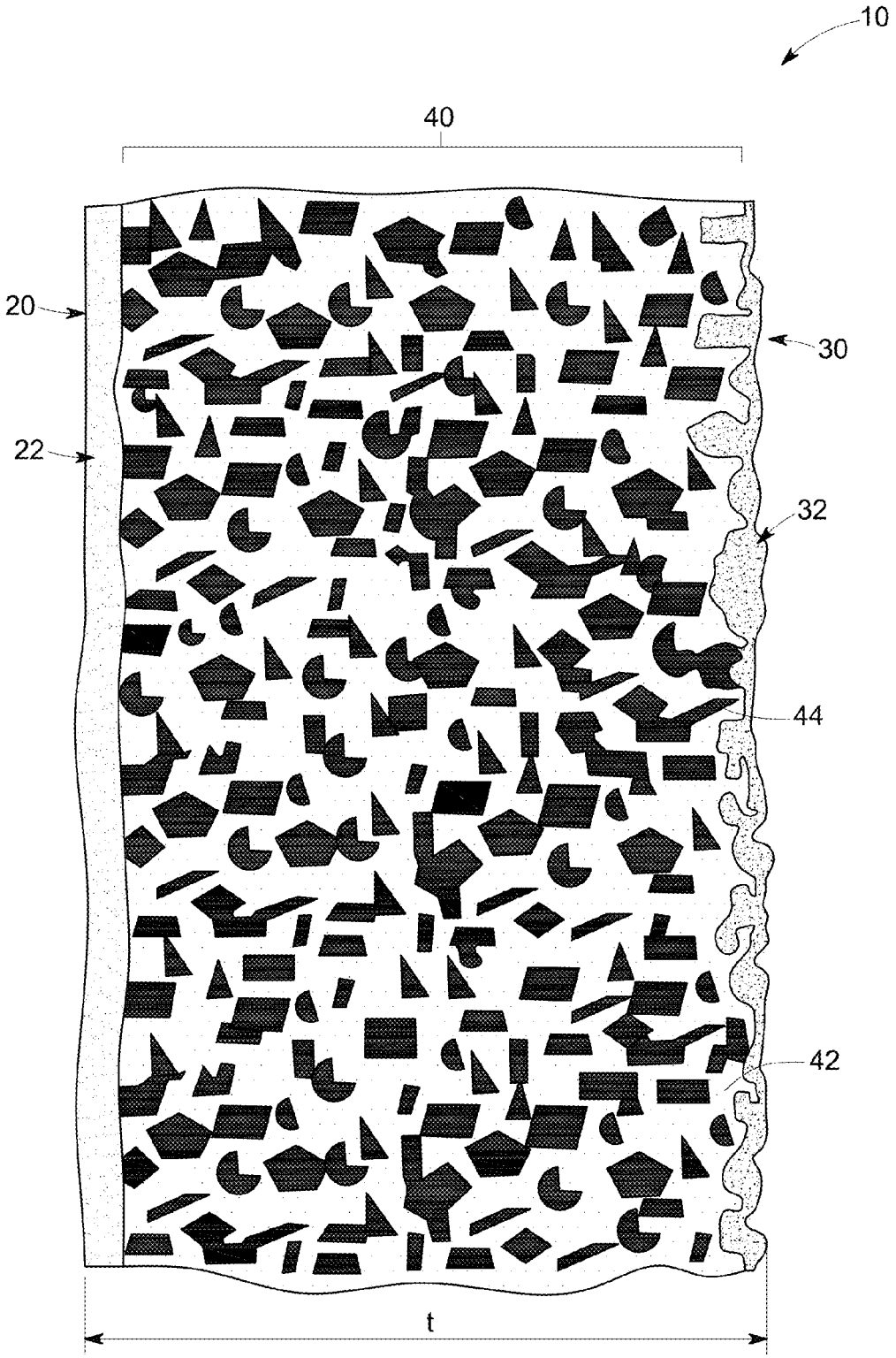
FIG. 1 is a schematic diagram of a shell mold, according to one embodiment of the invention.

One aspect of the invention is to provide a shell mold that exhibits high thermal conductivity. A schematic representation of such a shell mold 10 is shown in FIG. 1. The shell mold has an inner surface 20 and an outer surface 30. A facecoat 22 of the shell mold 10 is disposed at the inner surface 20 and a sealcoat 32 is disposed at the outer surface 30.

The facecoat 22 may include emissive compounds that advantageously increase the ability of the mold to absorb heat from surrounding solidifying metal during service. The facecoat 22 may include alumina and silica. In one embodiment, the facecoat 22 includes alumina, chromia, and/or titania particles. In one embodiment, the facecoat 22 includes the addition of green chromium (III) oxide to an alumina silica ($Al_2O_3$—$SiO_2$) mold slurry, which yields a high emissive ceramic mold upon firing and has exhibited an emittance greater than the emittance of the base alumina-silica coating without the green chromium oxide. In one embodiment, the high emissivity facecoat 22 of the shell mold 10 includes about 90 wt % of $Al_2O_3$, 2 wt % of $Cr_2O_3$, and 2 wt % of $TiO_2$ (all <50 microns), along with about 6 wt % of colloidal $SiO_2$ binder.

The sealcoat 32 includes a thin layer of high emissivity coating. In one embodiment, the sealcoat 32 is a single layer alumina coating without any coarse particles. This is particularly useful for the shell molds 10 used for liquid metal cooling mode DS casting. In particular embodiments where shell molds 10 are used in Bridgman mode DS casting, sealcoat 32 includes an alumina-based coating. Further, the seal coat 32 may include silicon carbide particles dispersed within. In one embodiment, the sealcoat 32 is a coating of a material that has more emissivity than alumina. In one embodiment, the sealcoat 32 is dark green in color. In one embodiment, the sealcoat 32 is a layer of coating of fine particles of silicon carbide material.

The shell mold 10 further includes a support 40 in between the inside surface 20 and the outside surface 30. The support 40 may include a fine particle dispersion 42 reinforced with plurality of coarse ceramic particulates generally called "stucco". Stucco may include plurality of coarse ceramic particulates arranged in one or more layer form. Generally, multiple layers of coarse particulates of alumina (alumina stucco) are used in the support of the shell molds. In one embodiment of this invention, high thermal conductivity stucco 44 is used, in replacement of the normally used low thermal conductivity alumina stucco, to build a high thermal conductivity thin-walled investment shell mold 10.

The high thermal conductivity stucco 44 is generally bound together in the support by the fine particle dispersion 42. The fine particle dispersion 42 may primarily include alumina and silica or alumina or silica with the optional additives of titanium oxide, refractory oxides, refractory carbides, or any combinations of the foregoing. In one embodiment, slurry of alumina and silica is used to bind the high thermal conductivity material stucco 44 together to form the support 40. In one embodiment, alumina is used in the partially sintered form and fused silica is used in the colloidal form for preparing the slurry, which may then be used for stuccoing and dried to get the fine particle dispersion 42 binding the particulates of stucco 44 together.

In one embodiment, the thermal conductivity of the material used as stucco 44 in the support 40 is greater than about 285 W/m-K. A higher percentage of high thermal conductivity stucco 44 material in the support 40 may raise the thermal conductivity of the support 40, thereby allowing a thinner support 40 and shell mold 10. In one embodiment, the stucco 44 in the support 40 is in a concentration greater than about 40 volume percent of the support 40. In one embodiment, the high thermal conductivity stucco 44 is in excess of about 50 volume percent of the support 40.

Any high thermal conductivity ceramic material may be used in the stucco form for the support 40 of the shell mold 10. Non-limiting examples of the high thermal conductivity stucco 44 material include materials such as silicon carbide, aluminum nitride, diamond, graphite, or any combination of the foregoing. In one embodiment, the support 40 includes silicon carbide stucco 44 in addition with alumina-silica fine particle dispersion 42.

The fine particle dispersion 42 and the stucco 44 may be arranged in the form of multiple layers (not shown) to increase the strength and thermal conductivity of the support 40. The layers may be arranged in parallel, or at an angle to the inner surface 20 or the outer surface 30 of the shell mold 40. The coarse particles of stucco 44 may be used as reinforcements in the fine particle dispersion 42 for forming the high-strength composite support 40.

The layers of the support 40 may be compositionally graded, so that properties are varied across the thickness of the shell mold wall. Other physical properties can also be adjusted by way of this compositional grading. For example, the proportionate increase in stucco 44 concentration may be beneficial when greater high temperature-creep resistance is desired. In some embodiments prompted by rigorous requirements for high-temperature mold stability, the secondary layers (e.g., about 2 to about 4 of them) farthest away from the facecoat 22 in the support 40 comprises at least about 90% by weight alumina in the fine particle dispersion 42, and in particular embodiments comprises substantially all alumina. Usually, the variation in layer composition is accomplished by the use of multiple fine particle dispersions containing the desired ingredients for a given layer.

The number of layers of the support 40 may depend on the desired thickness of the shell mold. As a non-limiting example, about 4 to about 20 total fine particle dispersion 42 layer/stucco 44 layer pairs are often used for the support 40. The typical shell thickness of the conventional shell molds is more than about 8 mm. Use of high thermal conductivity stucco 44 material as a part of the support 40 may enable the reduction in thickness of the support 40 and, therefore, the shell mold 10. As used herein, thickness "t" of the shell mold 10 is the cross-sectional diameter of the shell mold (including width of the face coat 22, sealcoat 32, and support 40) perpendicular to the inner surface 20 and/or the outer surface 30. In one embodiment, the support 40 has a thickness less than about 8 millimeter (mm). In one embodiment, the thickness of the support 40 is less than about 7 mm. In one embodiment, the shell mold 10 has a thickness less than about 7 mm, and the thickness of the support 40 is in a range from about 5 mm to 6 mm.

The size of the particulates of the stucco 44 that is used in the shell mold 10 may be greater than about 80 microns. In one embodiment, a median size of the plurality of particulates of stucco 44 is in a range from about 100 microns to about 300 microns.

In some embodiments, the support 40 includes layers with varying compositions or particle sizes. For example, one layer could be formed of high thermal conductivity stucco 44 material in combination with ceramic fine particle dispersion 42, while an adjacent layer might be formed from another high thermal conductivity stucco 44 material with the same or different ceramic fine particle dispersion 42. Furthermore, one or more layers may comprise stuccoes of one average size particulates, while one or more layers may comprise particulates of a different average size. For example, in one layer, the average size of the particulates of the stucco may be about 250 microns, while another layer may have particulates of about 150 particles. Alternately, the support 40 may have a bimodal or trimodal particulate size distribution. The presence of the stucco layers is helpful in providing greater strength to the mold when such an attribute is required. In one embodiment, the size of the particulates of stucco 44 in the support 40 may be gradationally increased from facecoat 22 side to the sealcoat 32 side. For example, a smaller particulate size stucco may be used for the first two layers to prevent the stucco from breaking through the facecoat layer where it may contact the cast metal and react chemically with the casting. These particles of stucco may be made of high thermal conductivity material. It is useful to gradually increase the particle size of the stucco as layers are added to increase the shell strength.

High thermal conductivity stucco 44 increases the overall thermal conductivity of the shell mold 10. In one embodiment, the shell mold 10 has a thermal conductivity value, at a direction perpendicular to the inner surface 20 and/or the outer surface 30, greater than about 2 W/m-K. In one embodiment, the thermal conductivity of a shell mold 10 prepared using SiC stucco 44 is greater than about 2.7 W/m-K.

The general steps used to form the molds as generally described above include forming the desired pattern by conventional methods. For example, a mold can be formed about a fugitive (removable) pattern having the shape of the cast part desired. The pattern may be made of wax, plastic, or other removable material as noted above.

The shell mold 10 may be prepared in three steps: coating, stuccoing, and drying. Coating involves dipping the pattern into a slurry of refractory materials and then letting any excess drain off, so that a uniform surface is produced.

In one embodiment, the particular ceramic slurry for forming the one or more facecoat 22 includes aluminum oxide, silicate, and green chromium oxide. Both alumina and green chromium oxide are commercially available as dry particles, i.e., flour, in a variety of sizes chosen carefully to control roughness of the mold inner surface and shape of the mold. The ceramic flour may be blended with colloidal silica or other suitable sol, such as for example water, to form the slurry. The fine facecoat 22 of high emittance is used to give a smooth surface finish and reproduce fine part details. In one embodiment, the alumina and green chromium oxide flours have a size of less than about 60 microns. The silica of the facecoat 22 is preferably used in the form of colloidal silica diluted with water, as required. Colloidal silica materials are commercially available from many sources, such as Nalco Chemical Company and Dupont.

In the second step, the support 40 may be formed by a ceramic slurry and high thermal conductive material coarse particles, such as, for example, silicon carbide stucco. One or more layers may be formed on the facecoat layer by repeating the sequence of dipping the pattern in the ceramic slurry, draining excess slurry, and stuccoing at requisite number of times corresponding to the desired number of layers or the thickness. In one embodiment, each slurry/stucco layer is dried prior to carrying out the next coating and stuccoing operation. The support 40 may also be built by using a fluidized bed process.

Low viscosity alumina slurry with Zahn cup #4 viscosities between 6 to 8.5 seconds may be used to build the support 40 layer by layer between the facecoat 22 and the seal coat 32 for a maximum stucco loading and acceptable shell mold 10 strength. Higher volume fraction of the high thermal conductivity stucco material in the support 40 increases shell thermal conductivity, but may reduce shell strength at certain point for given shell making practice. Therefore, a balance in the stucco volume fraction is achieved for obtaining a high thermal conductivity, high strength shell mold 10.

The sealcoat 32 may then be prepared as an outside layer by dip-coating in a dilute ceramic slurry, without stucco. The shell mold may then be allowed to dry in air for at least 24 to 48 hours before melting or vaporizing the fugitive pattern. To prevent shell failures occurring at this point, the fugitive pattern may be heated as rapidly as possible so that the surface of the pattern can melt into the surface of the shell mold or run out of the mold, making room for the rest of the pattern to expand. In the case when the fugitive material is a wax, for example, flash-dewaxing can be carried out by plunging the mold into a steam autoclave, operating at a temperature of about 100° C. to about 200° C. The autoclave is typically operated under steam pressure (about 90-120 psi), for about 10-20 minutes, although these conditions can vary considerably.

After removing fugitive pattern, shell molds may be prefired at a temperature in the range from about 800° C. 1150° C. in air to remove moisture, burn out any residual pattern material, and form chemically bonded shells. The shell mold can then be fired according to conventional techniques. The required regimen of temperature and time for the primary firing stage will of course depend on factors such as wall thickness, mold composition, silicate particle size, and the like. Typically, firing is carried out at a temperature in the range of about 1200° C. to about 1800° C., and in other embodiment's, about 1400° C. to about 1700° C. The shell molds face coated with high emittance materials may be subjected to an additional firing at 1480° C. to 1550° C. either in hydrogen for one hour or in a flowing inert gas-carbon monoxide mixture for about 30 to 90 minutes.

EXAMPLE

The following example is presented for illustrative purposes only, and is not intended to limit the scope of the invention.

High thermal conductivity of the shell mold 10 is a desirable property in many casting applications. For example, higher heat extraction rate in an alloy (ALNICO) casting having about 8-12 atomic % Al, about 15-26 atomic % Ni, about 5-24 atomic % Co, up to about 6 atomic % Cu, up to about 1 atomic % Ti, with the balance Fe, was shown to have a significant effect on the demagnetizing properties of the ALNICO alloys formed as can be seen from the following example.

Figure 2:
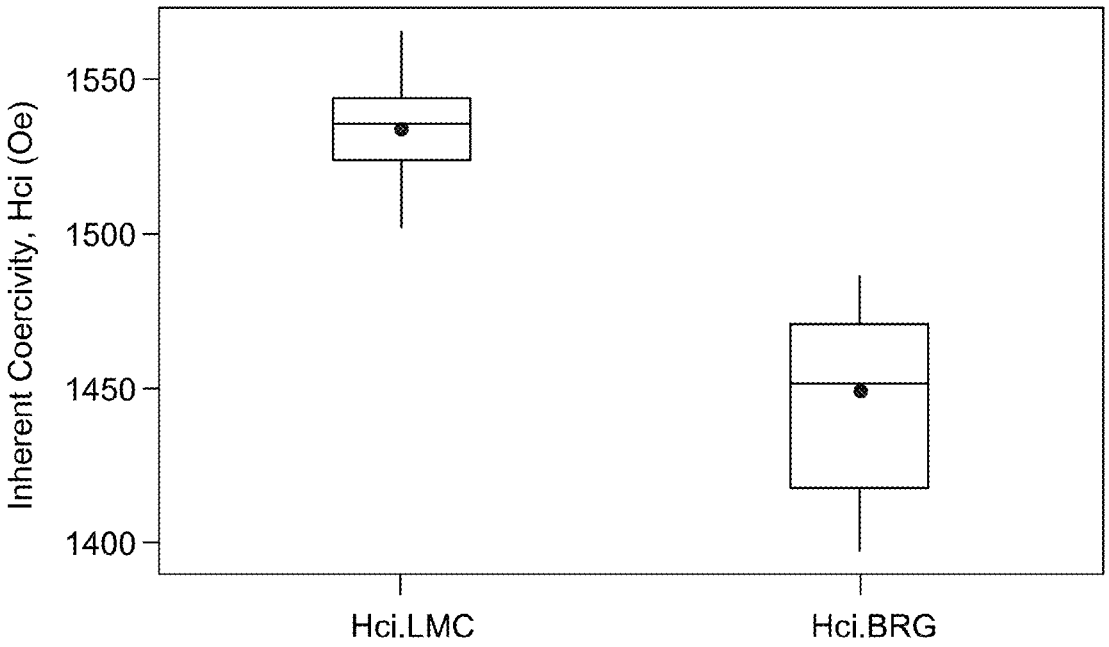
FIG. 2 is a graphical representation of an improvement obtained in the coercivity of an ALNICO permanent magnet formed by using a shell mold formed according to an embodiment of the present invention.
Figure 3:
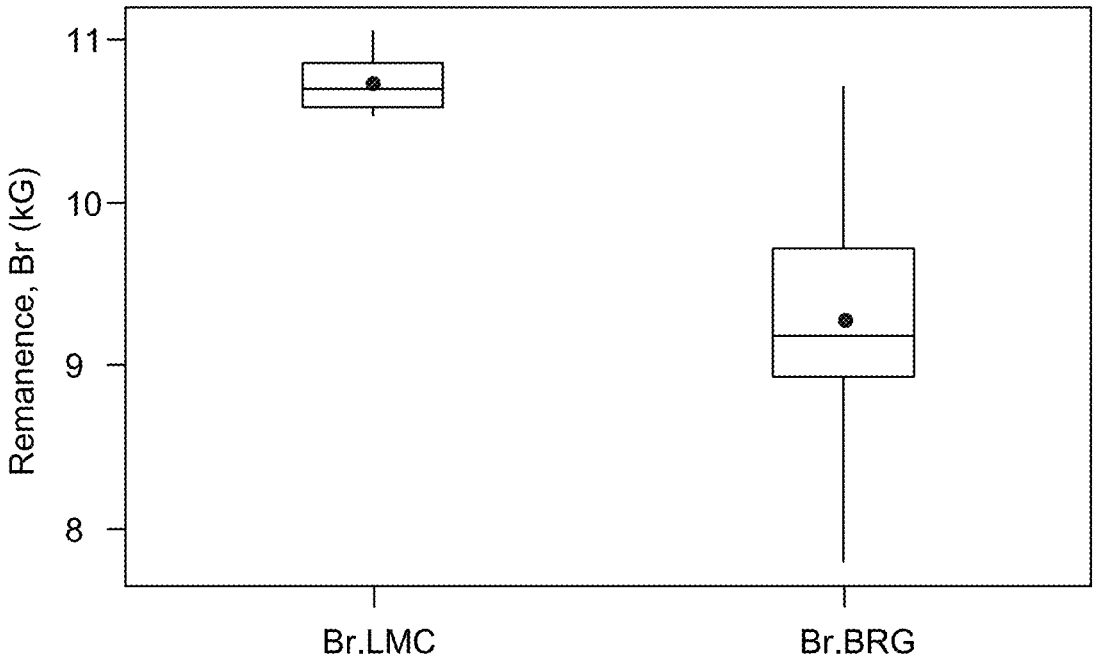
FIG. 3 is a graphical representation of an improvement obtained in the remanence of an ALNICO permanent magnet formed by using a shell mold formed according to an embodiment of the present invention.
Figure 4:
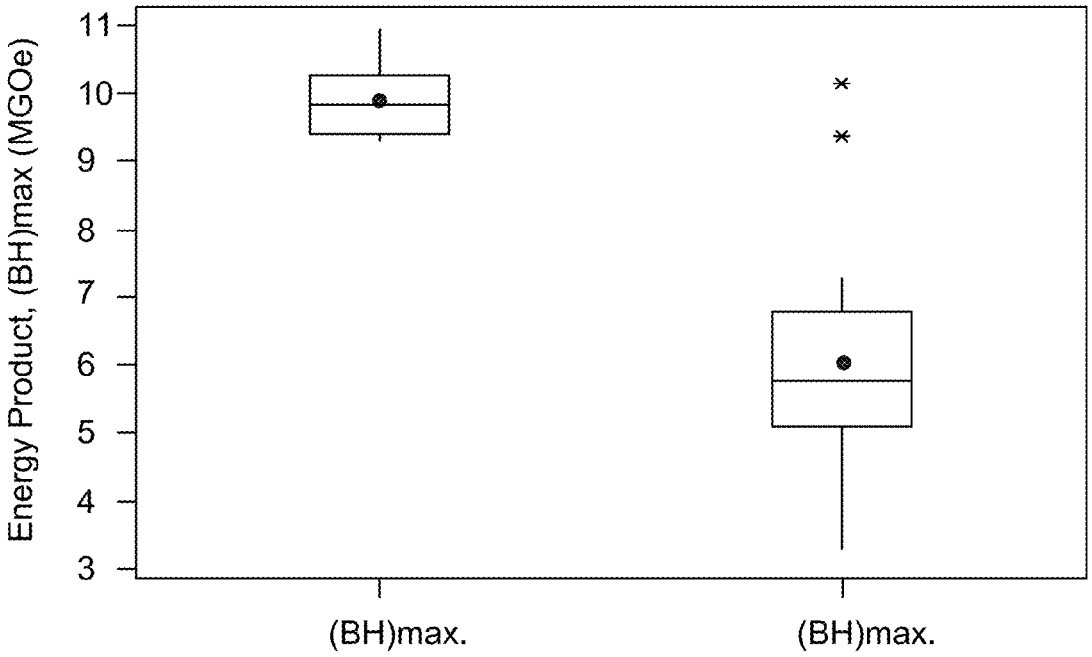
FIG. 4 is a graphical representation of an improvement obtained in the energy product of an ALNICO permanent magnet formed by using a shell mold formed according to an embodiment of the present invention.

The effects of heat extraction rate on inherent coercivity (Hci), remanence (Br), and energy product $(BH)_{max}$ are depicted in FIG. 2, FIG. 3, and FIG. 4 respectively. As used herein, LMC stands for liquid metal cooling directional solidification casting and BRG for Bridgman directional solidification casting.

The inherent coercivity of DS ALNICO castings made via liquid metal cooling (LMC) process is compared with that of made in Bridgman (BRG) process in FIG. 2 to demonstrate the effects of heat extraction rate on coercivity. Heat extraction rate in LMC ranges between 110 to 250 $W/m^2$, depending on the mold materials and shell thickness. Heat extraction rate in BRG process is about 60 $W/m^2$ to 80 $W/m^2$, depending on shell surface emissivity in vacuum. It was observed that, with the increase in heat extraction rate, the inherent coercivity also increases.

Further, it was observed from FIG. 3 that with the increase in heat extraction rate, the inherent remanence increases, and FIG. 4 shows the increase in energy product with the increase in heat extraction rate. Hence it can be seen that, as the thermal gradient increases the remanence and coercivity of the magnet increases, thereby increasing the energy product.

A shell mold 10 was prepared by using a high emissivity facecoat having about 89.48 wt % $Al_2O_3$, 2.24 wt % $Cr_2O_3$, and 1.78 wt % $TiO_2$ (all <50 microns) in a 6.5 wt % colloidal $SiO_2$ binder. The support 40 part was formed by dipping a fugitive pattern into alumina slurry 42 reinforced with high volume fraction of SiC stucco 44. Each coat of slurry and stucco were air-dried before subsequent coats were applied. The steps of dipping the pattern and drying were repeated until the desired thickness about 5 to 6 mm of the shell was obtained. Finally a thin layer of dark colored high emissivity SiC sealcoat 32 was applied to the surface 30. After air drying, and dewaxing, the shell was then heated to a temperature of about 1000° C. The shell mold 10 was subjected to an additional firing at 1480° C. to 1550° C. in $H_2$ for one hour.

The shell thermal conductivity, measured using Synthetic Thermal Time-Of-Flight Imaging (STTOF) method, was about 2.7 W/m-K, which is a 90% improvement in comparison with the regular alumina shell molds for the DS metal as shown in Table 1. The prepared SiC shell molds of 6 mm in thickness were applied to make directionally solidified Fe-based alloy castings using liquid metal cooling at withdrawal rates ranging from 4 to 12 inches/hour.

TABLE 1

| Specimen | Thickness in | Diffusivity, α | thermal conductivity, K(W/M-K) | Firing condition |
|---|---|---|---|---|
| SiC-01 | 0.155 | 0.027 | 2.61 | |
| SiC-02 | 0.149 | 0.032 | 3.10 | 1480 C. × 0.67 hr |
| SiC-03 | 0.17 | 0.027 | 2.61 | in argon-10%CO |
| SiC-04 | 0.18 | 0.026 | 2.52 | @ 6CFH |
| Mean | | 0.028 | 2.71 | 90% increase in K |
| Stdev | | <0.003 | 0.26 | in comparison with alumina |
| Alumina-B1 | 0.35 | 0.02 | 1.41 | 1550 C. × 1 hr |
| Alumina-B2 | 0.34 | 0.02 | 1.47 | in argon-10%CO |
| Alumina-B3 | 0.35 | 0.019 | 1.38 | @ 6CFH |
| Mean | | 0.02 | 1.42 | typical alumina shell mold |
| Stdev | | <0.0001 | 0.05 | thermal conductivity |

A shell mold 10 made by using the above example was used for LMC directional solidification processes for improved crystalline anisotropy (reduced crystalline misorientation) and refined as-cast structure fineness of ALNICO permanent magnets.

When liquid metal cooling is applied for directional solidification, heat extraction from solidifying casting is limited by shell thermal conductivity and shell thickness. A typical heat extraction rate for an alumina shell mold for LMC directional solidification was about 112 $W/m^2$. Using the thin, and high thermal conductive shell mold 10 of this example for LMC directional solidification process, the heat extraction rate of ALNICO thermal processing increased to about (240 $W/m^2$). The increased thermal gradient of the SiC shell mold provided fine microstructure of ALNICO magnets leading to high product yield and better product.

Further, high heat extraction of the shell mold helped in faster withdrawal of the structure thereby increasing the casting rate. Therefore, a DS casting of ALNICO magnet using the shell mold of this example helped in faster ALNICO manufacturing production, including enabling a time and energy efficient post-cast heat treatment of the ALNICO alloy. Various embodiments of this invention further provide a new solution to form fast-cooling shell molds for applicable equiaxed investment casting processes where fast cooling after mold fill is important to ensure desired casting metallurgical and mechanical properties.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A shell mold, comprising:

a facecoat disposed on an inner surface of the shell mold;

a sealcoat disposed on an outer surface of the shell mold; and a support in between the facecoat and sealcoat, comprising a stucco in a concentration greater than about 40 volume percent of the support, wherein the stucco comprises a material having a thermal conductivity greater than 285 W/m-K.

2. The shell mold of claim 1, wherein the stucco comprises a plurality of ceramic particulates, and wherein a median size of the plurality of particulates is greater than about 80 microns.

3. The shell mold of claim 2, wherein the median size of the plurality of particulates is in a range from about 100 microns to about 300 microns.

4. The shell mold of claim 1, wherein the material comprises silicon carbide, aluminum nitride, diamond, graphite, or a combination of any of the foregoing.

5. The shell mold of claim 4, wherein the stucco is made of silicon carbide material.

6. The shell mold of claim 1, wherein the support further comprises silica.

7. The shell mold of claim 1, wherein the support further comprises alumina fine particle dispersion.

8. The shell mold of claim 1, wherein the support has a thickness less than about 8 mm.

9. The shell mold of claim 1, wherein the shell mold has a thermal conductivity value greater than about 2 W/m-K.

10. The shell mold of claim 1, wherein the support comprises multiple layers.

11. The shell mold of claim 1, wherein the concentration of stucco is greater than about 50 volume percent of the support.

12. The shell mold of claim 1, wherein the facecoat comprises alumina, chromia, and titania particles.

13. The shell mold of claim 1, wherein the sealcoat comprises a coating having higher emissivity relative to an alumina coating.

14. The shell mold of claim 1, wherein the sealcoat comprises silicon carbide particles.

15. A shell mold, comprising:

a facecoat comprising alumina, disposed on an inner surface of the shell mold;

a high emissivity sealcoat disposed on an outer surface of the shell mold; and a support in between the facecoat and sealcoat, comprising silicon carbide stucco, greater than about 50 volume percent of the support in an alumina fine particle dispersion, wherein a median size of particulates of silicon carbide stucco is greater than about 100 microns, and a thickness of the shell mold is less than about 7 mm.

* * * * *